United States Patent [19]

Kirk

[11] Patent Number: 4,944,491

[45] Date of Patent: Jul. 31, 1990

[54] EXPANDING STAPLE REMOVER

[76] Inventor: Norbert Kirk, 1458 W. Belle Plaine, Chicago, Ill. 60613

[21] Appl. No.: 220,250

[22] Filed: Jul. 18, 1988

[51] Int. Cl.[5] ..... B25C 11/00

[52] U.S. Cl. ..... 254/28

[58] Field of Search ..... 254/28, 131, 18, 25; 227/63; 16/225, DIG. 3

[56] References Cited

U.S. PATENT DOCUMENTS

| | | | |
|---|---|---|---|
| D. 160,420 | 10/1950 | Pankonin . | |
| 2,375,942 | 5/1945 | Palmer | 254/28 |
| 2,624,545 | 1/1953 | Pankonin . | |
| 3,310,288 | 3/1967 | Berry | 254/28 |
| 3,484,080 | 12/1969 | Tolliver | 254/28 |
| 3,494,591 | 2/1970 | Fleming | 254/28 |
| 3,583,673 | 6/1971 | Poskin | 254/28 |
| 3,625,482 | 12/1971 | Viel, III . | |
| 3,761,057 | 9/1973 | Nembhard et al. . | |
| 4,054,263 | 10/1977 | Delia . | |
| 4,205,823 | 6/1980 | Goldy . | |
| 4,513,951 | 4/1985 | Rogers . | |
| 4,553,737 | 11/1985 | Yi | 254/28 |
| 4,674,727 | 6/1987 | McAlister . | |

FOREIGN PATENT DOCUMENTS

| | | | |
|---|---|---|---|
| 647634 | 7/1928 | France | 254/28 |

*Primary Examiner*—Robert C. Watson

[57] ABSTRACT

A staple remover for removing a staple from an object includes an elongate member which is progressively forced under a crown of the staple. The elongate member is preferably a larger claw member which cooperates with a smaller claw member in a pincer-like action. A protrusion or expanding member is provided on each lateral side of the elongate member with the distance between the protrusions being greater than the length of the crown of the staple and ending at a distance from the camming surface of the elongate member which is less than the length of a leg of the staple. Preferably, the protrusion extends generally parallel to the associated camming surface from adjacent the tip to a maximum protruding height which occurs where the distance between the associated camming surface and bearing surface is approximately 40 to 60% of the length of a leg of the staple. A groove is also provided in each lateral side which is spaced from the associated camming surface by a distance less than the length of a leg of the staple and into which the removed legs of the staple are received. Where the staple remover is pincer-like, the smaller claw members also preferably similarly formed with a protrusion. Overall, the distance between the protrusions is about 5 to 20% greater than the length of a crown of the staple.

31 Claims, 2 Drawing Sheets

EXPANDING STAPLE REMOVER

FIELD OF THE INVENTION

The present invention relates generally to staple removers, and more particularly to a staple remover which causes the staple to expand as it is removed from an object and which positively engages the staple to completely remove it from the object and retains the staple once it is removed from the object.

BACKGROUND OF THE INVENTION

Various staple removers have been disclosed in the prior art and are in common everyday usage. One of the simplest types of such staple removers is a "blade" remover. The tip of the blade is fitted under the staple in a object and the blade is tapered or wedged shape so that movement of the blade under the staple raises the staple up from the object. For example, such a staple remover is disclosed in U.S. Pat. No. 4,513,951 (Rogers), where the blade staple remover is attached to a stapler and includes a retaining clip for keeping the staples on the blade. A blade-type staple remover including a housing for removed staples at the upper end of the blade is also disclosed in U.S. Pat. No. 3,625,482 (Viel). An L-shaped staple remover with a slightly arcuate blade has been disclosed in U.S. Pat. No. 4,205,823 (Goldy). Another arcuate staple remover which includes slots 36 on either side of the blade in which the ends of the staple are retained is disclosed in U.S. Pat. No. 4,553,737 (Yi).

Another and perhaps the most popular type of staple remove has two opposed claw members and is operated in a pincer-like fashion. This basic design is disclosed in U.S. Design Pat. No. 160,420 (Pankonin). Various improvements to this basic device have been proposed in the prior art. For example, in U.S. Pat. Nos. 3,974,999 (Bertolet) and 4,054,263 (Delia), magnet means have been added to the claw members to retain removed staples thereto. The provision of a container for removed staples with a pincer-like staple remover has also been disclosed in U.S. Pat. No. 3,761,057 (Nembhard et al). A pincer-like staple remover which includes a bar disposed between the claw members for removing broken or partially removed staples is disclosed in U.S. Pat. No. 4,674,272 (McAlister).

As staple removers are generally inexpensively made, in order to guide the claw members in a telescoping movement, various guide means have been provided. Typically, such guide means is the shaping of the claw members with a U or channel shape. In U.S. Pat. No. 3,494,591 (Fleming), the claw members include flanges which act as guides. In addition, the teeth of the claw members are also suitably bent to help guide the inner teeth between the outer teeth. In particular, the outer teeth are bent slightly outwards, and the inner teeth slightly inwards to facilitate this movement. Another pincer-like staple remover provided with curved tips is disclosed in U.S. Pat. No. 2,624,545 (Pankonin). In this patent, the outer teeth are movably spaced from one another in order to accept staples of different widths.

While various staple removers have been disclosed in the art, the removal of staples from an object such as a plurality of sheets of paper is not always easily accomplished. In order to work effectively, both the blade and pincer staple removers require the legs of the staple to be released almost simultaneously from the object. Unfortunately, all too frequently this does not occur so that the released leg of the staple pops up out of the object relative to the unreleased leg so that the staple remover is no longer effective for the unreleased leg. Typically, the user must then remove the staple with their fingers. In addition, the staples removed by the staple remover are prone to falling from the staple remover and onto the floor or into copiers or other machinery where damage may result.

SUMMARY OF THE INVENTION

In accordance with the present invention, a staple remover is provided for removing a staple from an object such as a plurality of sheets of paper so as to positively pull both legs of the staple from the object. The staple remover includes an elongate member which is progressively forced under the crown of the staple. This elongate member includes lateral sides which are parallel and spaced apart a distance less than the length of the crown of the staple. Each lateral side converges to a tip. A lower bearing surface is provided at each lateral side to engage and slide along the object. An upper camming surface is also provided at each lateral side which diverges from the associated lower bearing surface at the associated tip. The upper camming surface slides beneath the crown of the staple and forces the crown of the staple along the upper camming surface and away from the object and the lower bearing surface. A protrusion is also provided on each lateral side between the associated camming surface and bearing surface. The distance between the protrusions is greater than the length of the crown of the staple. Each protrusion ends at a distance from the camming surface which is less than the length of a leg of the staple.

Each protrusion extends generally parallel to the associated camming surface from adjacent the tip to a maximum protruding height. This maximum height occurs where the distance between the associated camming surface and bearing surface is approximately 40 to 60% of the length of a leg of the staple.

The staple remover preferably includes a groove provided in each lateral side which is spaced from the associated camming surface by a distance less than the length of the leg of the staple. Each groove preferably begins longitudinally on the associated lateral side after a maximum of the protrusion. The groove then extends away from the associated tip and generally parallel to the associated camming surface.

In the preferred embodiment, the elongate member includes a longitudinal axis and is channel-shaped in lateral cross-section so as to have a cross piece and legs with free ends. The free ends then form the camming surfaces with a longitudinal proximal end of each leg forming the bearing surface. Each protrusion is a deformation in the associated lateral side or leg so that a corresponding concavity is provided along an inside surface of the leg opposite the associated protrusion. A second channel-shaped member is further provided together with a pivot means for connecting the distal end of the first-mentioned member and a distal end of the second member together to form a pincer-like unit with the second member telescopically received in the first-mentioned member. The second member also includes second legs which are received adjacent the legs of the first-mentioned member and second free ends which form second camming surfaces With this construction, the intersection of a first camming plane formed by the first-mentioned camming surfaces and a second camming plane formed by the second camming surfaces moves longitudinally toward the pivot means as the first-mentioned member telescopically receives the second member.

In the preferred embodiment of the present invention, each deformation in the lateral side also deforms the associated camming surface outwardly from an associated plane of the associated leg. In addition, each second leg is also provided with a similar deformation at a location corresponding to that part of each second leg which is overlapped by the deformation in an associated first-mentioned leg when the first-mentioned member telescopically receives the second member. This configuration keeps the camming surfaces of the associated first mentioned legs and second legs closely adjacent one another as the crown of the staple rides therealong.

Each second leg also includes a second longitudinal proximal end which forms second bearing surfaces. The second bearing surfaces together with the bearing surfaces of the first-mentioned member are substantially arcs of curvature having a center at the pivot means. With this construction, the planes formed by the bearing surfaces and the second bearing surfaces are substantially the same and present a broad surface area against the object during removal of the staple.

In the preferred embodiment, the distance between the protrusions is preferably 5 to 20% greater than the length of the crown of the staple.

From the above description, it will be appreciated that the present invention is in one embodiment an improvement of the simple pincer-like staple remover in common usage. The improvement comprises in its simplest form a protrusion or other expanding means located adjacent the associated tooth of each large claw member and provided on each lateral side between the associated camming surface and the other end of the lateral side. Further, a groove is provided in each lateral side of the large claw member into which the removed staple is forced to positively retain the staple to the staple remover.

It is an advantage of the present invention that staples are removed from objects simply and positively so that the occasions where a staple is not properly removed are remote.

It is also an advantage of the present invention that as the staple is removed from the object, the legs of the staple are forced outwards slightly from the crown of the staple facilitating removal of the staple from the object as well as reducing damage to the object as the legs of the staple are removed.

It is a further advantage of the present invention that once the staple is removed from the object, the staple is positively held to the staple remover, with additional staples piling up on the staple remover until positively removed by the user.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
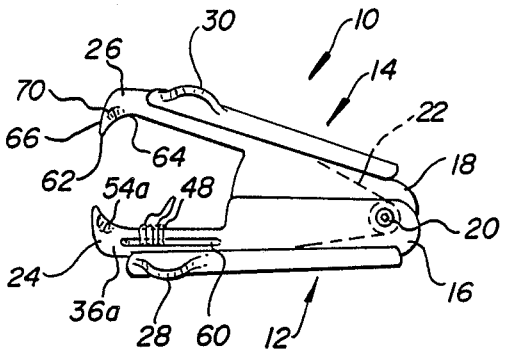
FIG. 1 is a side elevation view of a staple remover according to the present invention.

With reference now to the drawings in which like numerals represent like elements throughout the several views, a staple remover 10 according to the present invention is depicted in FIGS. 1–6. Staple remover 10 is pincer-like and is broadly similar to staple removers of this type well known to those of ordinary skill in the art as discussed above. In particular, staple remover 10 includes a larger channel-shaped claw member 12 and a smaller channel-shaped claw member 14. Each claw member 12 and 14 includes respective distal ends 16 and 18 which are pivotally connected by a pivot means 20. Pivot means 20 conveniently takes the form of a rivet 22 which is placed through apertures provided in both distal ends 16 and 18. A spring 22 (shown in phantom) urges respective proximal ends 24 and 26 of claw members 12 and 14 resiliently away from one another. Each claw member 12 and 14 also includes plastic finger engaging members 28 and 30 attached respectively thereto. Finger engaging members 28 and 30 are pressed together by the fingers and thumb of the user to actuate staple remover 10 a well known to those of ordinary skill in the art.

Figure 2:
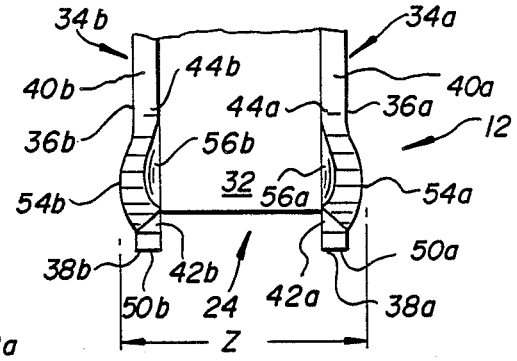
FIG. 2 is a top view of the proximal end of the large claw depicted in FIG. 1.
Figure 3:
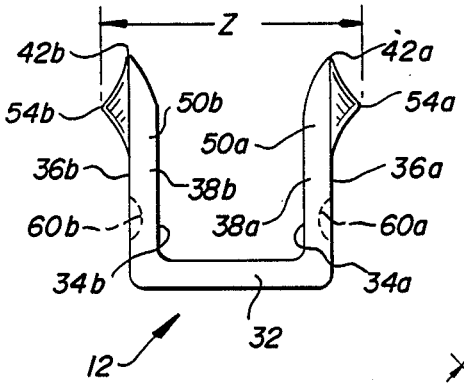
FIG. 3 is a front elevation view of the larger claw depicted in FIG. 2.
Figure 4:
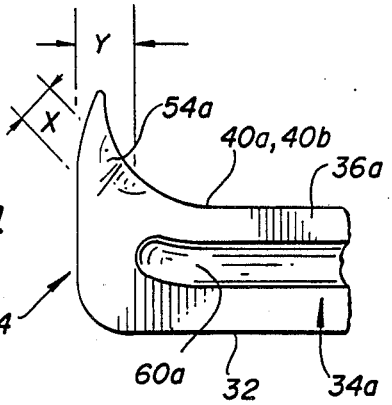
FIG. 4 is a side elevation view of the proximal end of the larger claw depicted in FIG. 3.

Depicted in FIGS. 2, 3, and 4, is proximal end 24 of larger claw member 12. As shown, larger claw member 12 is channel-shaped including a cross piece 32 and legs **34*a* and 34*b*. Legs 34*a* and 34*b* respectively include lateral sides 36*a* and 36*b*, longitudinal proximal ends 38*a* and 38*b*, and free ends 40*a* and 40*b***.

As shown best in FIGS. 1 and 4, free ends **40*a* and 40*b* curve upwardly adjacent respective longitudinal proximal ends 38*a* and 38*b* to form respective tips 42*a* and 42*b*. The curving portion of free ends 40*a* and 40*b* form respective camming surfaces 44*a* and 44*b* on top of which rides a crown 46 of a staple 48 as well known in the art and as explained subsequently with regard to FIG. 6. Adjacent tips 42*a* and 42*b*, longitudinal proximal ends 38*a* and 38*b* form respective bearing surfaces 50*a* and 50*b*, respectively. Bearing surfaces 50*a* and 50*b* engage the object from which staple 48 is removed, such as a plurality of sheets 52 of paper. Bearing surfaces 50*a* and 50*b* are substantially arcs of curvature having centers of the arcs at pivot means 20**.

Provided in lateral sides 36a and 36b are respective protrusions 54a and 54b. As depicted, protrusions 54a and 54b are formed by a deformation in respective legs 34a and 34b so that a corresponding concavity 56a and 56b is provided along an inside surface of each associated leg 34a and 34b. However, it should be appreciated that protrusions 54a and 54b could simply be formed by building up respective lateral sides 36a and 36b if desired.

As shown best in FIG. 4, protrusion 54a extends generally parallel to camming surface 44a and ends at a distance X from camming surface 44a which is less than the length of a leg 58 of staple 48 and preferably at a distance from camming surface 44a of about 50 to 80% of the length of leg 58. In addition, protrusion 54a includes a maximum height from lateral side 36a at a distance Y between camming surface 44a and bearing surface 50a which is approximately 40 to 60% of the length of the leg 58 of staple 48. Protrusion 56b is similarly configured. Furthermore, as shown in FIG. 2, a distance Z between protrusions 54a and 54b is greater than the length of crown 46 of staple 48, and preferably 5 to 20% greater than the length of crown 46 of staple 48.

Each lateral side 36a and 36b of legs 34a and 34b also includes a respective groove 60a and 60b. As shown best in FIG. 4, groove 60a begins in lateral side 36a at about the same longitudinal position where protrusion 54a ends. Groove 60a extends longitudinally along lateral side 36a as shown in FIG. 1. Groove 60a is spaced from free end 40a by a distance less than the length of leg 58 of staple 48. The center of groove 60a is preferably about 50 to 80% of the length of leg 58.

Figure 5:
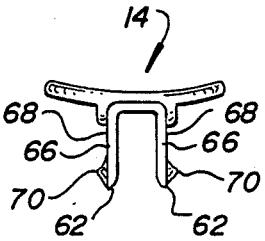
FIG. 5 is a front elevation view of a smaller claw depicted in FIG. 1.

In the preferred embodiment of staple remover 10, smaller claw member 14 is shaped similar to larger claw member 12 as shown in FIG. 5. Thus, smaller claw member 14 also includes tips 62 from which camming surfaces 64 and bearing surfaces 66 diverge. In addition, lateral sides 68 also have formed in them respective protrusions 70 at a similar position and complimentary shaped to the concavities 56a and 56b of larger claw member 12.

With this preferred construction, protrusions 70 mate with respective concavities 56a and 56b as smaller claw member 14 is received in larger claw member 12. As camming surfaces 44a and 44b are bowed outward at the location of respective protrusions 54a and 54b, camming surfaces 64 of smaller claw member 14 are similarly bowed out at the same positions so that a smaller claw member 14 is received in larger claw member 12, the areas of respective camming surfaces 44a and 44b of larger claw member 12 and camming surfaces 64 of smaller claw member 14 remain immediately adjacent one another and thus best support crown 46 of staple 48 as staple 48 is removed from sheets 52. In addition, bearing surfaces 66, which are also arcs of curvature having pivot means 20 as a center, form a plane with bearing surfaces 50a and 50b.

In operation, staple remover 10 functions in the following manner. As with other pincer-like staple removers, staple remover 10 is positioned adjacent a staple 48 with teeth or tips 42a and 42b on one side of crown 46 of staple 48 and tip 62 on the other side. By pinching small claw member 14 and larger claw member 12 together, tips 42a, 42b, and 62 are initially forced between crown 46 and sheets 52. Further pressing together of claw members 12 and 14 causes crown 46 to slide along camming surfaces 44a, 44b, and 64. Due to the curvature of camming surfaces 44a, 44b, and 64, crown 46 is raised from sheets 52 as bearing surfaces 50a, 50b, and 66 engage sheets 52.

With the present invention, protrusions 54a and 54b act as an expanding means for legs 58 of staple 48 as crown 46 is raised above sheets 52. Thus, as depicted in FIG. 6, legs 58 of staple 48 are pushed outward as well as upward as larger claw member 12 is forced beneath crown 46.

The expanding action of protrusions 54a and 54b helps to withdraw legs 58 from underneath sheets 52 as legs 58 are somewhat straightened during the pulling action. However, it should be appreciated that even after being withdrawn from sheets 52, each leg 58 includes a hook portion substantially as that depicted in FIG. 6. Thus, as each free end of leg 58 emerges from sheets 52, that free end snaps into place against the respective lateral side 36a and 36b. Because of the configuration of respective protrusions 54a or 54b, the free end of leg 58 is located below or slightly on respective protrusion 54a and 54b, and is thus trapped on larger claw member 12. Consequently, even if one leg 58 of staple 48 pulls free of sheets 52 before the other leg 58, the free end of leg 58 which pulls free first is trapped beneath the associated protrusion 54a or 54b so that crown 46 continues along camming surfaces 44a and 44b to assure that the other leg 58 is positively pulled from sheets 52. By contrast, without the presence of protrusions 54a and 54b or a similar expanding member, the free end of leg 58 which comes free before the other leg 58 will allow crown 46 to pop away from camming surfaces 44a and 44b so that the other leg 58 is not acted on and thus remains engaged with sheets 52.

When both legs 58 have been pulled from sheets 52, the free ends of both legs 58 will be located below respective protrusions 54a and 54b. Then, the continued closing action of staple remover 10 causes camming surfaces 44a and 44b to continue to raise crown 46 toward pivot means 20. As this occurs, the free ends of legs 58 are pulled from respective protrusions 54a and 54b into respective grooves 60a and 60b. Thus, removed staple 48 remains trapped on larger claw member 12 as the free ends resiliently engage in respective grooves 60a and 60b. Because of this, there is no opportunity for removed staple 48 to fall away from staple remover 10 after larger claw member 12 and smaller claw member 14 are returned to the initial position by spring 22. Rather, removed staples 48 line up on larger claw member 12 as depicted in FIG. 1. Because removed staples 48 are resiliently held by the respective free ends in grooves 60a and 60b, removed staples 48 can be positively removed by the user when it is desired to make additional room for newly removed staples.

Figure 6:
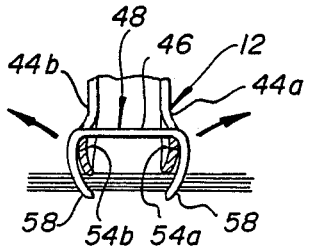
FIG. 6 is a cross-sectional view of a staple being removed from sheets of paper by the larger claw member and with the smaller claw member removed for clarity.

It should be appreciated that smaller claw member 14 has been omitted from FIG. 6 for clarity. In addition, it should also be appreciated that while a smaller claw member 14 having protrusion 70 is preferred, a smaller claw member 14 without such protrusions would also function almost as well. In fact, it would be appreciated from FIG. 6 that a blade-type staple remover including a suitable expanding means is also possible.

Figure 7:
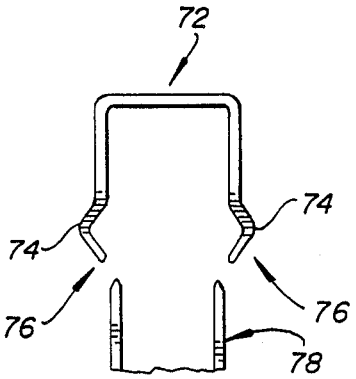
FIG. 7 is a front elevation view of an alternative embodiment of a larger claw according to the present invention.k

Depicted in FIG. 7 is alternative embodiment of a larger claw member 72 which is similar to larger claw member 12. However, whereas protrusion 54a and 54b of larger claw member 12 was provided behind bearing surfaces 50a and 50b, in this embodiment protrusions 74 are simply provided by bending tip region 76 as shown. With this embodiment, it should also be apparent that smaller claw member 78 must include straight tip regions in order to be telescopically received in larger claw member 72.

Figure 8:
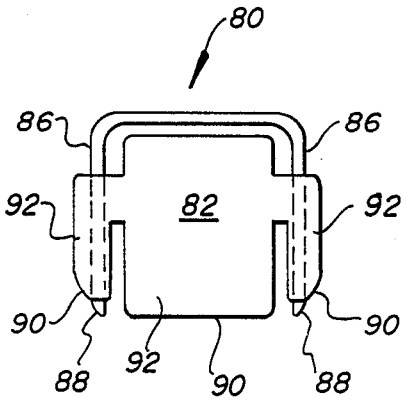
FIG. 8 is a front elevation view of still another embodiment of a larger claw according to the present invention.
Figure 9:
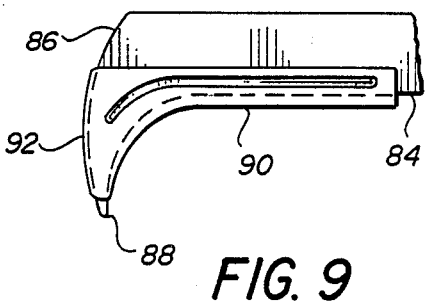
FIG. 9 is a side elevation view of the larger claw depicted in FIG. 8.

Depicted in FIGS. 8 and 9 is a larger claw member 80. Larger claw member 80 has a simple channel shape as shown. However, an insert 82 has been provided in the center of larger claw member 80 and extending around free ends 84 and proximal ends 86. Thus, insert 82 together with tip 88 forms camming surfaces 90 and bearing surfaces 92. The wing members of insert 82 on the outside of free ends 84 form protrusions 94 similar to protrusions 54*a* and 54*b*. In addition, a groove 96 is also provided on each side of insert 82 similar to groove 60*a* and 60*b*. Larger claw member 80 functions in a manner similar to larger claw member 12, except that camming surfaces 90 include a central portion as shown best in FIG. 8. It should be appreciated that the openings 98 on either side of central camming surface 90 allows for the reception of the smaller claw member associated with larger claw member 80. A central bearing surface 92 is also provided with this configuration.

Figure 10:
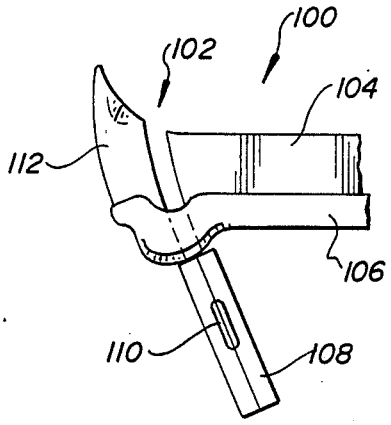
FIG. 10 is a side elevation view of still another alternative embodiment of a larger claw according to the present invention including a staple holding box.
Figure 11:
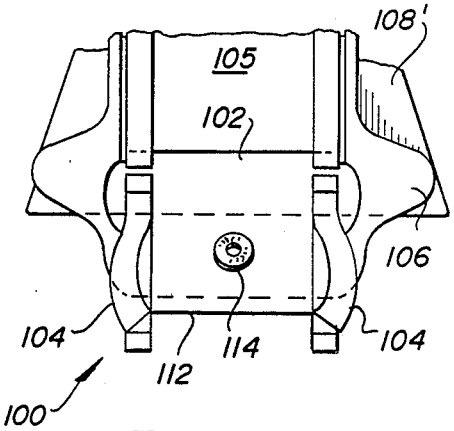
FIG. 11 is a top view of a proximal end of still another alternative embodiment similar to the embodiment shown in FIG. 10.

Depicted in FIGS. 10 and 11 is still another alternative embodiment of a larger claw member 100 which in this embodiment is shaped similar to larger claw member 12. However, a slot 102 has been cut in both legs 104 as well as in crosspiece 105 for the legs and additionally through finger engaging member 106. Attached to finger engaging member 106 in the FIG. 10 embodiment is a box or enclosure 108 into which slot 102 extends. Box 108 extends away from slot 102 as shown and is openable by pushing the top of box 108 away from the bottom at notch 110.

In FIG. 11, it can be seen that proximal end 112 of claw member 100 is physically separated from the remainder of claw member 100 by slot 102. Proximal end 112 is held in place by a rivet 114 or other attaching means for holding proximal end 112 to the underlying portion of finger-engaging member 106. In this FIG. 11 embodiment, a box 108' is provided which is basically triangular shaped and which extends parallel to and is directly attached to finger-engaging member 106. The triangular shape of box 108' broadly matches the similar outline of finger-engaging member 106, although box 108' could also be rectangular for greater capacity. Thus, when using this embodiment, the user presses against the finger-engaging member of the small claw member and against box 108' at the location opposite to finger-engaging member 106. If desired, box 108' could have a cupped portion to facilitate location of the fingers of the user therein during use just as similar bowed portions are typically provided on the finger-engaging members.

In operation, larger claw member 100 functions in the same manner as larger claw member 12. However, as staples are received onto larger claw member 12, the camming action of the smaller claw member pushes the staples into slot 102. As further staples build up in slot 102, the additional staples push the first removed staples through slot 102 into box 108. In this manner, a large number of staples can be accumulated in box 108 before emptying is required.

Thus, while the present invention has been described with respect to an exemplary embodiment thereof, it will be understood by those of ordinary skill in the art that variations and modifications can be effected within the scope and spirit of the invention.

I claim:

1. A staple remover for removing a staple from an object comprising:

an elongate member which is progressively forced under a crown of the staple, said member including (a) flat lateral sides which are parallel and spaced apart a distance less than the length of the crown of the staple, each said lateral side converging to a tip, (b) a lower bearing surface at each said lateral side which engages and slides along the object, (c) an upper camming surface at each said lateral side which engages and slides along the object, (c) an upper camming surface at each said lateral side which diverges from an associated said lower bearing surface at the associated tip and upon which the crown of the staple slides to force the crown of the staple away from the object, and (d) a protrusion sticking out from each said flat lateral side between the associated said camming surface and bearing surface, the distance between the protrusions being greater than the length of the crown of the staple; and each said protrusion of the associated said lateral side (i) ending at a distance from the associated camming surface which is less than the length of a leg of the staple; and (ii) extending generally parallel to the associated said camming surface from adjacent the tip of the associated said lateral side to a maximum protruding height which maximum height occurs where the distance between the associated said camming surface and bearing surface is approximately 40 to 60% of the length of a leg of the staple.

2. A staple remover as claimed in claim 1 and further including a groove provided in each said lateral side which is spaced from the associated camming surface by a distance less than the length of the leg of the staple.

3. A staple remover as claimed in claim 2 wherein each said groove begins longitudinally on the associated said lateral side after a maximum of the associated said protrusion and extends away from the associated tip and generally parallel to the associated said camming surface.

4. A staple remover as claimed in claim 2 wherein said member includes a longitudinal axis and is channel-shaped in lateral cross section so as to have a cross piece and legs with free ends, with the free ends forming said camming surfaces and a longitudinal proximal end of each leg forming said bearing surface; and wherein each said protrusion is a deformation in the associated said lateral side which is formed by an associated said leg such that a corresponding concavity is provided along an inside surface of each associated said leg opposite the associated said protrusion.

5. A staple remover as claimed in claim 4 wherein said member includes a proximal end at which said tips are located and a distal end spaced longitudinally from said proximal end; and further including a second channel-shaped member and a pivot means for connecting said distal end of said first-mentioned member and a distal end of said second member together to form a pincer-like unit with said second member telescopically received in said first-mentioned member, said second member including (a) second legs which are received adjacent said legs of said first mentioned member when said first-mentioned member telescopically receives said second member, and (b) second free ends of said second legs which form second camming surfaces such that the intersection of a first camming plane formed by said first-mentioned camming surfaces and a second camming plane formed by said second camming surfaces moves longitudinally toward said pivot means as said first-mentioned member telescopically receives said second member.

6. A staple remover as claimed in claim 5 wherein each said deformation in said lateral sides also deforms each associated said camming surface outwardly from an associated plane of the associated said leg; and wherein each said second leg is provided with a similar deformation at a location corresponding to that part of each said second leg which is overlapped by the deformation in an associated said first-mentioned leg when said first-mentioned member telescopically receives said second member.

7. A staple remover a claimed in claim 6 and further including second longitudinal proximal ends of each said second leg forming second bearing surfaces which together with said bearing surfaces of said first-mentioned member are substantially arcs of curvature having said pivot means as a center such that the planes formed by said bearing surfaces and said second bearing surfaces are the same.

8. A staple remover as claimed in claim 1 wherein the distance between said protrusions is 5–20% greater than the length of the crown of the staple.

9. A pincer-like staple remover for removing staples from an object of the type having a larger and a smaller opposed pair of channel-shaped claw members which are hingedly connected at a distal end such that said larger claw member telescopically receives said smaller claw member, each claw member including (a) lateral sides, (b) a concave camming surface along a facing edge of the lateral sides adjacent the teeth, (c) a bearing surface along the proximal end of each said lateral side, and (d) spaced apart teeth at an intersection of each associated said camming surface and bearing surface, the improvement comprising:

a protrusion located adjacent each associated tooth of the large claw member and provided on each lateral side between the associated camming surface and the associated bearing surface, the distance between the two protrusions being greater than the length of a crow of the staple and each said protrusion extending to a distance along the associated lateral side from the associated camming surface which is less than the length of a leg of the staple.

10. A pincer-like staple remover as claimed in claim 9 wherein each said protrusion extends generally parallel to the associated said camming surface from adjacent the associated said tooth to a maximum protruding height where the distance between the associated camming surface and bearing surface is approximately equal to 40 to 60% of the length of a leg of the staple.

11. A pincer-like staple remover a claimed in claim 9 and further including a groove provided in each said lateral side of each said larger claw member which is spaced from the associated camming surface by a distance less than the length of the leg of the staple.

12. A pincer-like staple remover as claimed in claim 11 wherein each said groove begins longitudinally on the associated said lateral side after a maximum of the associated protrusion and extends away from the associated tooth and generally parallel to the associated said camming surface.

13. A pincer-like staple remover as claimed in claim 12 wherein each said protrusion is a deformation in the associated said lateral side of said larger claw member such that a corresponding cavity is provided along an inside surface of each said lateral side opposite said protrusion.

14. A pincer-like staple remover as claimed in claim 13 wherein each said deformation in said lateral sides also deforms each associated said camming surface outwardly from an associated plane of the associated said side; and wherein each said lateral side of said smaller claw member is provided with a similar deformation at a location corresponding to that part of each said lateral side of said smaller claw member which is overlapped by the deformation in an associated said lateral side of said larger claw member when said larger claw member telescopically receives said small claw member.

15. A pincer-like staple remover as claimed in claim 11 wherein the distance between said protrusions is 5–20% greater than the length of the crown of the staple.

16. A pincer-like staple remover for removing staples from an object of the type having a larger and a smaller opposed pair of channel-shaped claw members which are hingedly connected at a distal end such that said larger claw member telescopically receives said smaller claw member, each claw member including (a) lateral sides, (b) a concave camming surface along an inside edge of the lateral sides adjacent the teeth, (c) a bearing surface along the proximal end of each said lateral side, and (d) spaced apart teeth at an intersection of each associated said camming surface and bearing surface, the improvement comprising:

an expanding means for forcing the legs of the staple to be separated from each other by a distance greater than the length of the crown of the staple as the legs of the staple are pulled from the object, said expanding means including an expanding element provided on the outer surface of each lateral side of the large claw member adjacent the respective tooth and associated camming surface such that the distance between the two expanding elements is greater than the length of the crown of the staple and the distance from the associated camming surface to an end of said expanding element is less than the distance from the end of the leg of the staple received on the staple remover to the crown of the staple such that each end of the staple rides underneath the associated said expanding element as the staple is removed from the object.

17. A pincer like staple remover as claimed in claim 16 and further including a groove provided in each said lateral side of each said larger claw member which is spaced from the associated camming surface by a distance less than the length of the leg of the staple.

18. A pincer-like staple remover as claimed in claim 17 wherein each said expanding element is a deformation in the associated said lateral side of said larger claw member such that a corresponding cavity is provided along an inside surface of each said lateral side opposite said deformation.

19. A pincer-like staple remover as claimed in claim 18 wherein each said deformation in said lateral sides also deforms each associated said camming surface outwardly from an associated plane of the associated said side; and wherein each said lateral side of said smaller claw member is provided with a similar deformation at location corresponding to that part of each said lateral side of said smaller claw member which is overlapped by the deformation in an associated said lateral side of said larger claw member when said larger claw member telescopically receives said small claw member.

20. A pincer-like staple remover as claimed in claim 19 wherein the distance between outer surfaces of said deformations is 5–20% greater than the length of the crown of the staple.

21. A pincer-like staple remover as claimed in claim 20 wherein each said deformation extends generally parallel to the associated said camming surface from adjacent the associated said tooth to a maximum protruding height where the distance between the associated camming surface and bearing surface is approximately equal to 40 to 60% of the length of a leg of the staple.

22. A staple remover as claimed in claim 2 wherein each said protrusion is formed on an associated wing member which is securely attached to said elongate member.

23. A staple remover as claimed in claim 22 wherein each said wing member extends along each associated said lateral side and in which each associated said groover is formed.

24. A staple remover as claimed in claim 1 and further including a slot in said elongate member which extends from said upper camming surface at a position on the side of said protrusion opposite the tip through said lateral sides, and an enclosure into which said slot extends such that as a plurality of staples are successively removed successive staples force previous staples through said slot and into said enclosure.

25. A pincer-like staple remover as claimed in claim 11 wherein each said protrusion is formed on an associated wing member which is securely attached to said large claw member.

26. A pincer-like staple remover as claimed in claim 25 wherein each said wing member extends along each associated said lateral side and in which each associated said groove is formed.

27. A pincer-like staple remover as claimed in claim 9 and further including a slot formed in said large claw member which extends from said associated concave camming surface at a position on the side of said protrusion opposite said associated teeth through said lateral sides, and an enclosure into which said slot extends such that as a plurality of staples are successively removed successive staples force previous staples through said slot and into said enclosure.

28. A pincer-like staple remover as claimed in claim 17 wherein said expanding means includes a wing member provided along the outside of each said lateral side of said larger claw member and a protrusion formed on each said wing member.

29. A pincer-like staple remover as claimed in claim 28 wherein each said wing member extends along each associated said lateral side and in which each associated said groover is formed.

30. A pincer-like staple remover as claimed in claim 29 wherein each said wing member is integrally formed with a central insert located between said lateral sides of said large claw member, said insert extending around said lateral sides of said large claw member to said wing members to form said bearing surfaces and said concave camming surfaces of said large claw member.

31. A pincer-like staple remover as claimed in claim 16 and further including a slot formed in said large claw member which extends from said associated concave camming surface at a position on the side of said expanding means opposite said associated teeth through said lateral sides, and an enclosure into which said slot extends such that as a plurality of staples are successively removed successive staples force previous staples through said slot and into said enclosure.

* * * * *